US011610469B2

(12) United States Patent
Ishikawa et al.

(10) Patent No.: US 11,610,469 B2
(45) Date of Patent: Mar. 21, 2023

(54) ABNORMAL BEHAVIOR NOTIFICATION DEVICE, ABNORMAL BEHAVIOR NOTIFICATION SYSTEM, ABNORMAL BEHAVIOR NOTIFICATION METHOD, AND RECORDING MEDIUM

(71) Applicant: TOYOTA JiDOSHA KABUSHIKI KAISHA, Toyota (JP)

(72) Inventors: Marie Ishikawa, Nagoya (JP); Aya Hamajima, Nagoya (JP); Daichi Hotta, Minato-ku Tokyo (JP); Hayato Ito, Susono (JP); Hidekazu Sasaki, Yokohama (JP); Yasuhiro Kobatake, Nagoya (JP); Akihiro Kusumoto, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/566,027

(22) Filed: Dec. 30, 2021

(65) Prior Publication Data

US 2022/0284796 A1 Sep. 8, 2022

(30) Foreign Application Priority Data

Mar. 2, 2021 (JP) ..... JP2021-032645

(51) Int. Cl.
*G08B 23/00* (2006.01)

(52) U.S. Cl.
CPC ..... *G08B 23/00* (2013.01)

(58) Field of Classification Search
CPC ..... G08B 23/00
See application file for complete search history.

(56) References Cited

U.S. PATENT DOCUMENTS

| | | | | |
|---|---|---|---|---|
| 8,786,425 | B1 * | 7/2014 | Hutz | G08B 23/00 340/541 |
| 8,988,200 | B2 * | 3/2015 | Lee | G06K 1/18 340/676 |
| 2010/0253594 | A1 * | 10/2010 | Szczerba | G08G 1/167 345/7 |
| 2013/0243252 | A1 * | 9/2013 | Xu | G06V 10/42 382/103 |
| 2020/0117928 | A1 * | 4/2020 | Nishimura | G06V 20/56 |
| 2022/0019823 | A1 * | 1/2022 | Ucar | G06V 20/597 |
| 2022/0172626 | A1 * | 6/2022 | Baik | G08G 1/167 |

FOREIGN PATENT DOCUMENTS

JP 2020-061079 A 4/2020

* cited by examiner

*Primary Examiner* — Travis R Hunnings
(74) *Attorney, Agent, or Firm* — Dinsmore & Shohl LLP

(57) ABSTRACT

A server includes: a registration unit that registers identification information for identifying a detection target in a storage unit; a detection target determination unit that determines whether the detection target is shown in an image captured on or around a road, based on the identification information; an abnormal behavior determination unit that determines whether the detection target exhibits an abnormal behavior that is different from a normal behavior of the detection target, when the detection target is shown in the image; and an alert transmission unit that transmits an alert when the detection target exhibits the abnormal behavior.

18 Claims, 13 Drawing Sheets

ABNORMAL BEHAVIOR NOTIFICATION DEVICE, ABNORMAL BEHAVIOR NOTIFICATION SYSTEM, ABNORMAL BEHAVIOR NOTIFICATION METHOD, AND RECORDING MEDIUM

CROSS-REFERENCE TO RELATED APPLICATION

This application claims priority to Japanese Patent Application No. 2021-032645 filed on Mar. 2, 2021, incorporated herein by reference in its entirety.

BACKGROUND

1. Technical Field

The present disclosure relates to an abnormal behavior notification device, an abnormal behavior notification system, an abnormal behavior notification method, and a recording medium.

2. Description of Related Art

Conventionally, the following technique is known (see, for example, Japanese Unexamined Patent Application Publication No. 2020-61079 (JP 2020-61079 A)). When a first vehicle detects a traffic violation vehicle with an in-vehicle camera, the first vehicle transmits an evidence image of the traffic violation, characteristic information of the traffic violation vehicle, etc. to a server, and the server transmits the characteristic information of the traffic violation vehicle to a second vehicle that is located near the estimated position of the traffic violation vehicle. The second vehicle captures images of the license plate, driver, etc. of the traffic violation vehicle and transmits the images to the server, and the server transmits this information to a client (police system, etc.).

SUMMARY

In recent years, vehicle theft techniques have become more sophisticated, and vehicles can be stolen silently. Also, vehicle theft may take only several minutes. For this reason, even if the vehicle is parked in the garage at home, it is difficult to catch the criminal by capturing the scene of the theft. Therefore, there is a need for vehicle owners to be urgently notified when their possessions behave differently than usual, such as when the vehicle is stolen.

Further, with the arrival of an aging society with a declining birthrate, it is socially important to watch over persons certified as requiring long-term care and the elderly living alone. For related persons such as family members or friends of the person certified as requiring long-term care or an elderly person, if the person certified as requiring long-term care or the elderly person behaves differently than usual or wanders about, there are safety concerns such as the person certified as requiring long-term care or the elderly person will be missing or will get involved in some kind of trouble. Therefore, there is a need for these related persons to be urgently notified when the person certified as requiring long-term care or the elderly person behaves differently than usual, such as when the person certified as requiring long-term care or the elderly person wanders about.

The technique described in JP 2020-61079 A is to capture images of a license plate, a driver, etc. of a traffic violation vehicle and provide the images to a client when an unspecified traffic violation vehicle is detected. Thus, it is not assumed that information is provided to the user when the object or person desired to be watched over by the user behaves differently than usual as described above, and there is room for improvement.

In view of the above issue, an object of the present disclosure is to provide an abnormal behavior notification device, an abnormal behavior notification system, an abnormal behavior notification method, and a recording medium that enable an alert to be notified when a detection target desired to be watched over by a user exhibits an abnormal behavior different than usual.

The gist of the present disclosure is as follows.

(1) An abnormal behavior notification device including: a registration unit that registers identification information for identifying a detection target in a storage unit; a determination unit that determines whether the detection target is shown in an image captured on or around a road, based on the identification information; an abnormal behavior determination unit that determines whether the detection target exhibits an abnormal behavior that is different from a normal behavior of the detection target, when the detection target is shown in the image; and a transmission unit that transmits an alert when the detection target exhibits the abnormal behavior.

(2) The abnormal behavior notification device according to (1) described above, in which the image is an image captured by a mobile body traveling on the road.

(3) The abnormal behavior notification device according to (2) described above, in which: the normal behavior is that the detection target moves in a predetermined movement route and a predetermined time zone; and the abnormal behavior determination unit determines that the detection target exhibits the abnormal behavior that is different from the normal behavior when a position of the detection target based on a position of the mobile body when the image showing the detection target is captured is not included in the predetermined movement route, or when a time at which the image is captured is not included in the predetermined time zone.

(4) The abnormal behavior notification device according to any one of (1) to (3) described above, in which the detection target is a vehicle, and the identification information is information of a license plate of the vehicle.

(5) The abnormal behavior notification device according to any one of (1) to (3) described above, in which the detection target is a specific person, and the identification information is a facial image of the specific person.

(6) The abnormal behavior notification device according to any one of (1) to (5) described above, in which the registration unit registers the identification information received from a user terminal.

(7) The abnormal behavior notification device according to (6) described above, in which the registration unit registers the normal behavior received from the user terminal together with the identification information.

(8) The abnormal behavior notification device according to (6) or (7) described above, in which the transmission unit transmits the alert to the user terminal.

(9) The abnormal behavior notification device according to (3) described above, further including an estimation unit that specifies, based on the identification information, from a plurality of images showing the detection target captured by the mobile body in the past, positions of the detection target when the images are captured, and estimates the predetermined movement route and the predetermined time zone based on the specified positions of the detection target and imaging times of the images.

(10) The abnormal behavior notification device according to (1) described above, in which: the detection target is a specific person, and the normal behavior is that the specific person is accompanied by an attendant; and when the specific person is shown in the image and the same other person is not shown in the image continuously for a predetermined time or more within a predetermined distance from the specific person, the abnormal behavior determination unit determines that the specific person exhibits the abnormal behavior that is different from the normal behavior.

(11) The abnormal behavior notification device according to (10) described above, in which the identification information is a facial image of the specific person.

(12) An abnormal behavior notification system including a user terminal owned by a user and an abnormal behavior notification device communicably connected to the user terminal, the abnormal behavior notification system including: an acquisition unit that acquires identification information for identifying a detection target input to the user terminal; a registration unit that registers the identification information in a storage unit; a determination unit that determines whether the detection target is shown in an image captured on or around a road, based on the identification information; an abnormal behavior determination unit that determines whether the detection target exhibits an abnormal behavior that is different from a normal behavior of the detection target, when the detection target is shown in the image; and a transmission unit that transmits an alert to the user terminal when the detection target exhibits the abnormal behavior.

(13) An abnormal behavior notification method including: a step of registering identification information for identifying a detection target in a storage unit; a step of determining whether the detection target is shown in an image captured on or around a road, based on the identification information; a step of determining whether the detection target exhibits an abnormal behavior that is different from a normal behavior of the detection target, when the detection target is shown in the image; and a step of transmitting an alert when the detection target exhibits the abnormal behavior.

(14) A recording medium recording a program that causes a computer to function as: a registration unit that registers identification information for identifying a detection target in a storage unit; a determination unit that determines whether the detection target is shown in an image captured on or around a road, based on the identification information; a determination unit that determines whether the detection target exhibits an abnormal behavior that is different from a normal behavior of the detection target, when the detection target is shown in the image; and a transmission unit that transmits an alert when the detection target exhibits the abnormal behavior.

The present disclosure exerts an effect that makes it possible to provide an abnormal behavior notification device, an abnormal behavior notification system, an abnormal behavior notification method, and a program that enable an alert to be notified when a detection target desired to be watched over by a user exhibits an abnormal behavior different than usual.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, several embodiments according to the present disclosure will be described with reference to the drawings. However, these descriptions are intended merely to illustrate embodiments of the present disclosure and are not intended to limit the present disclosure to such particular embodiments.

Figure 1:
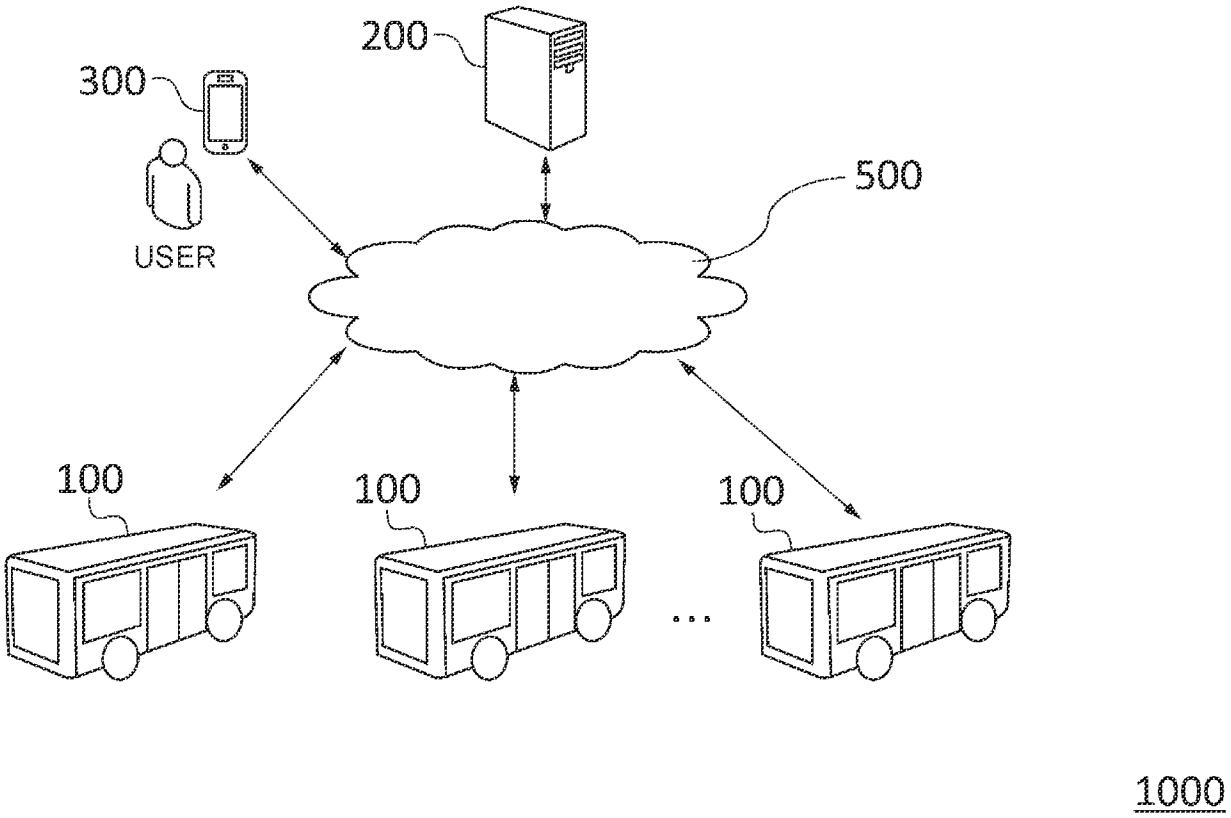
FIG. 1 is a schematic diagram showing a configuration of an abnormal behavior notification system according to an embodiment of the present disclosure.

FIG. 1 is a schematic diagram showing a configuration of an abnormal behavior notification system 1000 according to an embodiment of the present disclosure. The abnormal behavior notification system 1000 includes one or a plurality of mobile bodies 100 traveling on a road, a server 200, and a user terminal 300 that can be operated by a user. The mobile bodies 100, the server 200, and the user terminal 300 are communicably connected to each other via a communication network 500 such as the Internet. The mobile bodies 100, the server 200, and the user terminal 300 may be connected via wireless communication such as WiFi, a wireless network of a mobile phone network such as long term evolution (LTE), LTE-Advance, fourth generation (4G), and fifth generation (5G), a dedicated network such as virtual private network (VPN), and a network such as local area network (LAN).

The mobile body 100 is a vehicle such as an automobile that travels on the road. In the present embodiment, as an example, the mobile body 100 is an autonomous driving bus that travels on a road based on a predetermined command and transports passengers, and is regularly operated in a smart city. A smart city is a sustainable city or district for which management (planning, maintenance, management and operation, etc.) is performed while utilizing new technologies such as information and communication technology (ICT) to address various issues of the city in an effort to realize overall optimization, which is proposed by the Ministry of Land, Infrastructure, Transport and Tourism. The mobile body 100 is not limited to a vehicle that is autonomously driven, and may be a vehicle that is manually driven.

The mobile body 100 is provided with a camera, captures images of the surroundings of the mobile body 100 during operation, and generates images showing surrounding vehicles, people, structures, and the like. Consequently, the mobile body 100 transmits the generated image to the server 200.

The server 200 is a device that manages a plurality of mobile bodies 100, and issues an operation command to each mobile body 100. The operation command includes information such as the operation route and the operation time of the mobile body 100, and bus stops where the mobile body 100 stops, and is transmitted from the server 200 to the mobile body 100. The server 200 receives the image transmitted from the mobile body 100, and when the detection target registered in advance is displayed in the image and the detection target exhibits an abnormal behavior that is different from usual, issues an alert (warning). The alert is transmitted to, for example, the user terminal 300 that has registered the detection target.

The user terminal 300 is, for example, a portable computer such as a smartphone, a mobile phone terminal, a tablet terminal, a personal information terminal, or a wearable computer (smart watch or the like). The user terminal 300 may be a personal computer (PC). In order to register the detection target in the server 200, the user terminal 300 transmits the registration information related to the detection target to the server 200. Further, the user terminal 300 receives the alert transmitted from the server 200 and notifies the user of the alert.

The detection target is a target for which the user requests detection of the abnormal behavior, and corresponds to a vehicle (automobile) owned by the user, a person (family, friends, etc.), an object, a structure, or the like that the user watches over. The detection target widely includes anything the user requests to detect the abnormal behavior, such as pets owned by the user, a home of the user (entrance, windows, walls, etc.), as long as images of the detection target can be captured by the camera of the mobile body 100.

Since the mobile body 100 is regularly operated in the smart city, the situation of vehicles, people, structures, or the like in the smart city is recorded in the images captured by the camera of the mobile body 100. Therefore, the server 200 can monitor the events occurring in the smart city by collecting and analyzing the images captured by the mobile body 100. In particular, when there are a plurality of the mobile bodies 100, the server 200 can monitor the events occurring in the smart city in detail based on more images.

The camera does have to be provided on the mobile body 100, and may be, for example, a plurality of surveillance cameras (fixed point cameras) installed at predetermined locations in the smart city. In this case, the abnormal behavior notification system 1000 is configured by connecting the surveillance cameras, the server 200, and the user terminal 300 so as to be able to communicate with each other via the communication network 500 such as the Internet. Also in this case, the server 200 can monitor the events occurring in the smart city by collecting and analyzing the images captured by the surveillance cameras.

When the detection target registered in the server 200 exists on or near the operation route of the mobile body 100 while the mobile body 100 is in operation, the detection target encounters the mobile body 100 and its image is captured by a camera equipped in the mobile body 100. When an image of the detection target is captured, the server 200 recognizes the position and time of the detection target at the time of imaging by using the captured image and the position information of the mobile body 100. When the image of the detection target is captured, the server 200 recognizes the state of the detection target at the time of imaging from the image. Upon recognizing the above, the server 200 determines whether the detection target exhibits an abnormal behavior that is different from the normal behavior of the detection target registered in the server 200.

The abnormal behavior of the detection target includes the case where the detection target exists in a time or location that is different from usual, such as when the detection target exists in a time zone different than usual, or when the detection target exists in a location different than usual. For example, when the detection target is a vehicle and the vehicle is mainly used for commuting in the morning and evening, the time zone and route in which the vehicle is driven are generally constant. In this case, the normal behavior of the vehicle is to travel on the commuting route in the time zone during the morning and evening hours, and it is an abnormal behavior for the vehicle to travel in the time zone during the daytime hours or for the vehicle to travel on a different route than the commuting route. In addition, when the detection target is an elderly person, the time zone and route for the elderly person to take a walk are often fixed. In this case, the normal behavior of the elderly person is to take a walk on the usual route during the usual time zone, and it is an abnormal behavior that is different from usual for the elderly person to take a walk at a time zone different from the usual time zone, or for the elderly person to take a walk on a different route than the usual route.

Further, the abnormal behavior of the detection target includes a case where the detection target is in a state different from the normal state, such as a case where the detection target is acting in a state different from the normal state. For example, when the detection target is a specific person, and the specific person usually acts together with another person, the abnormal behavior of the detection target is that the specific person acts alone. For example, when the detection target is a person certified as requiring long-term care, the person certified as requiring long-term care often takes a walk with an accompanying caregiver. In this case, the normal behavior of the person certified as requiring long-term care is to take a walk with a caregiver, and it is an abnormal behavior that is different from usual for the person certified as requiring long-term care to go out alone. Further, for example, when the detection target is a gate at home and the gate is normally closed, the abnormal behavior of the detection target is when the gate is open.

In order to detect the abnormal behavior of these detection targets, a combination of the detection target and the normal behavior of the detection target is registered in advance in the server 200. Registration is performed based on the registration information related to the detection target transmitted from the user terminal 300.

When the detection target exhibits an abnormal behavior that is different from usual, the user who has received the alert can take appropriate actions based on the alert. For example, when the detection target is a vehicle owned by the user, the vehicle may have been stolen and the user can notice the theft at an early stage, so that actions can be made immediately such as calling the police. As a result, early arrest of the criminal is achieved. When the detection target is a person certified as requiring long-term care or an elderly person, the detection target may behave differently than usual or wander about, so that the user who has received the alert can take actions such as searching.

Figure 2:
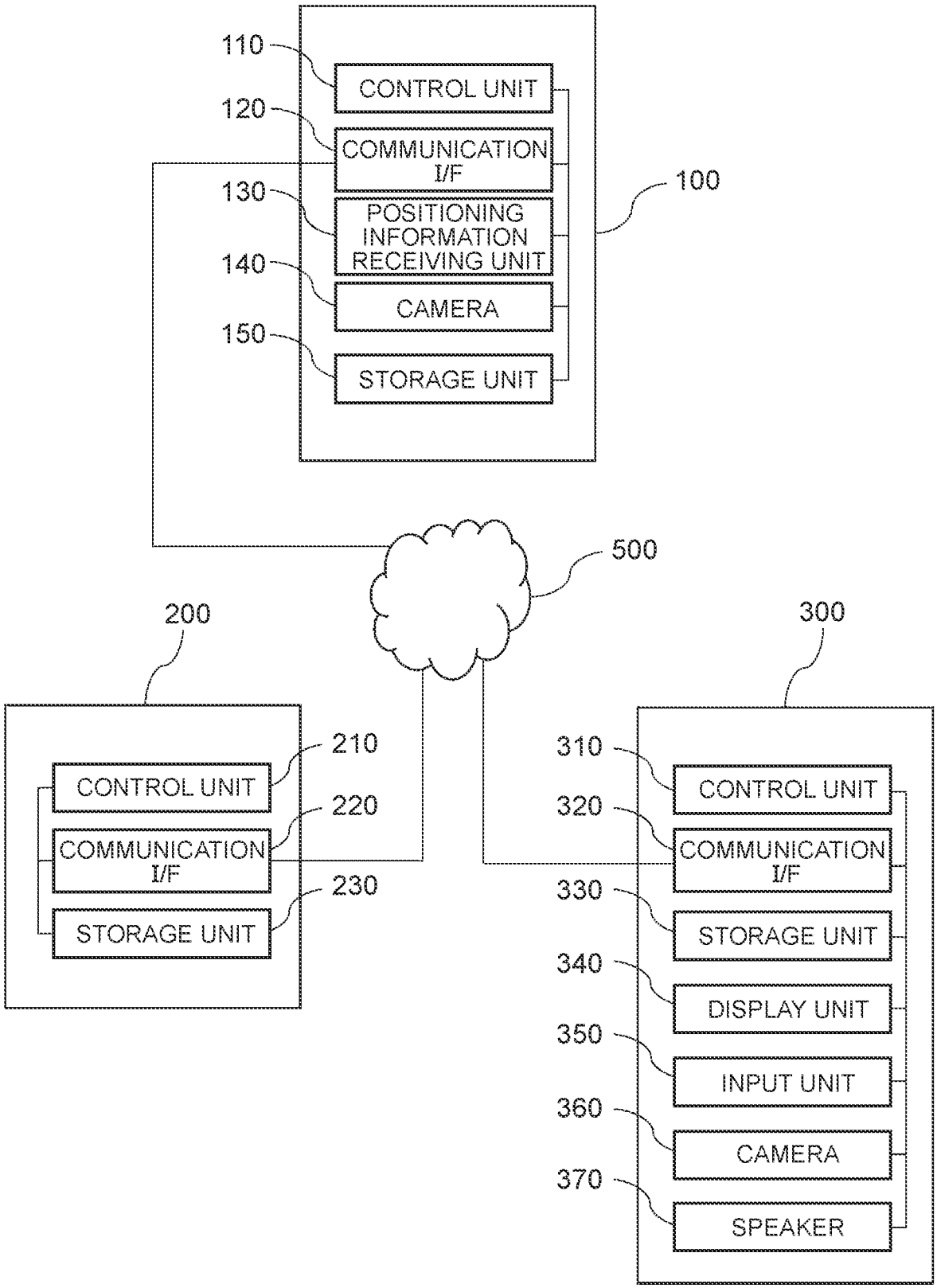
FIG. 2 is a block diagram showing a hardware configuration of a mobile body, a server, and a user terminal.

FIG. 2 is a block diagram showing a hardware configuration of the mobile body 100, the server 200, and the user terminal 300. The mobile body 100 includes a control unit 110, a communication interface (I/F) 120, a positioning information receiving unit 130, a camera 140, and a storage unit 150. The control unit 110, the communication I/F 120, the positioning information receiving unit 130, the camera 140, and the storage unit 150 are connected to each other via an in-vehicle network that complies with standards such as controller area network (CAN) and Ethernet (registered trademark).

The control unit 110 of the mobile body 100 is composed of a processor. The processor has one or more central processing units (CPUs) and peripheral circuits thereof. The processor may further include other arithmetic circuits such as a logical operation unit, a numerical operation unit, or a graphic processing unit. The control unit 110 provides a function that meets a predetermined purpose by controlling peripheral devices such as the positioning information receiving unit 130 or the camera 140 through execution of a computer program executably deployed in the work area of the storage unit 150.

The communication I/F 120 of the mobile body 100 is a communication interface between the communication network 500, and includes, for example, an antenna and a signal processing circuit that executes various processes related to wireless communication such as modulation and demodulation of wireless signals. The communication I/F 120 receives, for example, a downlink radio signal from a radio base station connected to the communication network 500, and transmits an uplink radio signal to the radio base station. The communication I/F 120 takes out a signal transmitted from the server 200 to the mobile body 100 from the received downlink radio signal and passes the signal to the control unit 110. Further, the communication I/F 120 generates an uplink radio signal including the signal transmitted from the control unit 110 to the server 200, and transmits the radio signal.

The positioning information receiving unit 130 of the mobile body 100 acquires positioning information indicating the current position and posture of the mobile body 100. For example, the positioning information receiving unit 130 can be a global positioning system (GPS) receiver. Each time the positioning information receiving unit 130 receives the positioning information, the positioning information receiving unit 130 outputs the acquired positioning information to the control unit 110 via the in-vehicle network.

The camera 140 of the mobile body 100 is an in-vehicle camera having a two-dimensional detector composed of an array of photoelectric conversion elements having sensitivity to visible light such as a charge coupled device (CCD) or complementary metal-oxide semiconductor (C-MOS), and an imaging optical system that forms an image of a region to be imaged and detected on the two-dimensional detector. The camera 140 is provided toward the outside of the mobile body 100. The camera 140 captures images of the surroundings of the mobile body 100 (for example, front of the mobile body 100) such as on or around the road at predetermined imaging cycles (for example, 1/30 second to 1/10 second), and generates images showing the surroundings of the mobile body 100. The camera 140 may be composed of a stereo camera, and may be configured to acquire the distance from each structure in the image, based on the parallax of the right and left images. Each time the camera 140 generates an image, the camera 140 outputs the generated image to the control unit 110 via the in-vehicle network together with the imaging time.

The storage unit 150 of the mobile body 100 has, for example, a volatile semiconductor memory and a non-volatile semiconductor memory. Information such as internal parameters of the camera 140 is stored in the storage unit 150. The internal parameters include the mounting position of the camera 140 on the mobile body 100, the posture of the camera 140 with respect to the mobile body 100, the focal length of the camera 140, and the like.

The server 200 has a control unit 210, a communication I/F 220, and a storage unit 230, which is one mode of the abnormal behavior notification device. The control unit 210 of the server 200 is composed of a processor, as in the control unit 110 of the mobile body 100. The communication I/F 220 of the server 200 includes a communication module connected to the communication network 500. For example, the communication I/F 220 may include a communication module that complies with a wired local area network (LAN) standard. The server 200 is connected to the communication network 500 via the communication I/F 220. As in the storage unit 150 of the mobile body 100, the storage unit 230 of the server 200 has, for example, a volatile semiconductor memory and a non-volatile semiconductor memory.

The user terminal 300 has a control unit 310, a communication I/F 320, a storage unit 330, a display unit 340, an input unit 350, a camera 360, and a speaker 370. The control unit 310 is composed of a processor, as in the control unit 110 of the mobile body 100.

The communication I/F 320 of the user terminal 300 is configured in the same manner as the communication I/F 120 of the mobile body 100. As in the storage unit 150 of the mobile body 100, the storage unit 330 of the user terminal 300 has, for example, a volatile semiconductor memory and a non-volatile semiconductor memory. The display unit 340 of the user terminal 300 is composed of, for example, a liquid crystal display (LCD), and displays an alert when the user terminal 300 receives an alert from the server 200. The input unit 350 of the user terminal 300 is composed of, for example, a touch sensor, a mouse, a keyboard, and the like, and information according to the user's operation is input. When the input unit 350 is composed of a touch sensor, the display unit 340 and the input unit 350 may be configured as an integrated touch panel. The camera 360 of the user terminal 300 is configured in the same manner as the camera 140 of the mobile body 100, and has a two-dimensional detector composed of an array of photoelectric conversion elements, and an imaging optical system that forms an image of a region to be imaged and detected on the two-dimensional detector. The speaker 370 of the user terminal 300 issues an alert by voice when the user terminal 300 receives an alert from the server 200.

Figure 3:
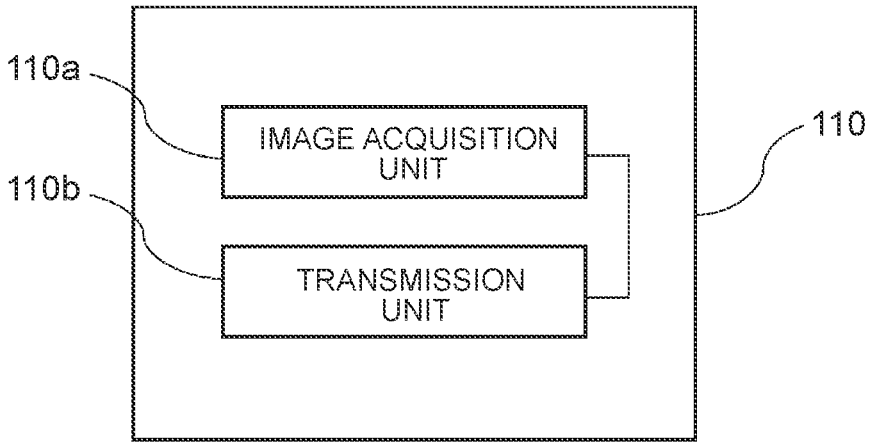
FIG. 3 is a schematic diagram showing a functional block of a control unit provided on the mobile body.

FIG. 3 is a schematic diagram showing a functional block of the control unit 110 provided on the mobile body 100. The control unit 110 of the mobile body 100 has an image acquisition unit 110*a* and a transmission unit 110*b*. Each of these units included in the control unit 110 is, for example, a functional module realized by a computer program operating on the control unit 110. That is, each of these units included in the control unit 110 is composed of the control unit 110 and a program (software) for operating the control unit 110. Further, the program may be recorded in the storage unit 150 of the mobile body 100 or a recording medium connected from the outside. Alternatively, each of these units included in the control unit 110 may be a dedicated arithmetic circuit provided in the control unit 110.

The image acquisition unit 110*a* of the control unit 110 acquires the image data generated by the camera 140. For example, the image acquisition unit 110*a* acquires an image generated by the camera 140 at predetermined time intervals. The image data is associated with the imaging time.

The transmission unit 110*b* of the control unit 110 performs a process of transmitting, to the server 200 via the communication I/F 120, the image acquired by the image acquisition unit 110*a*, the imaging time at which the image was captured, the positioning information received by the positioning information receiving unit 130 at the imaging time at which the image was captured, and the internal parameters of the camera 140.

Figure 4:
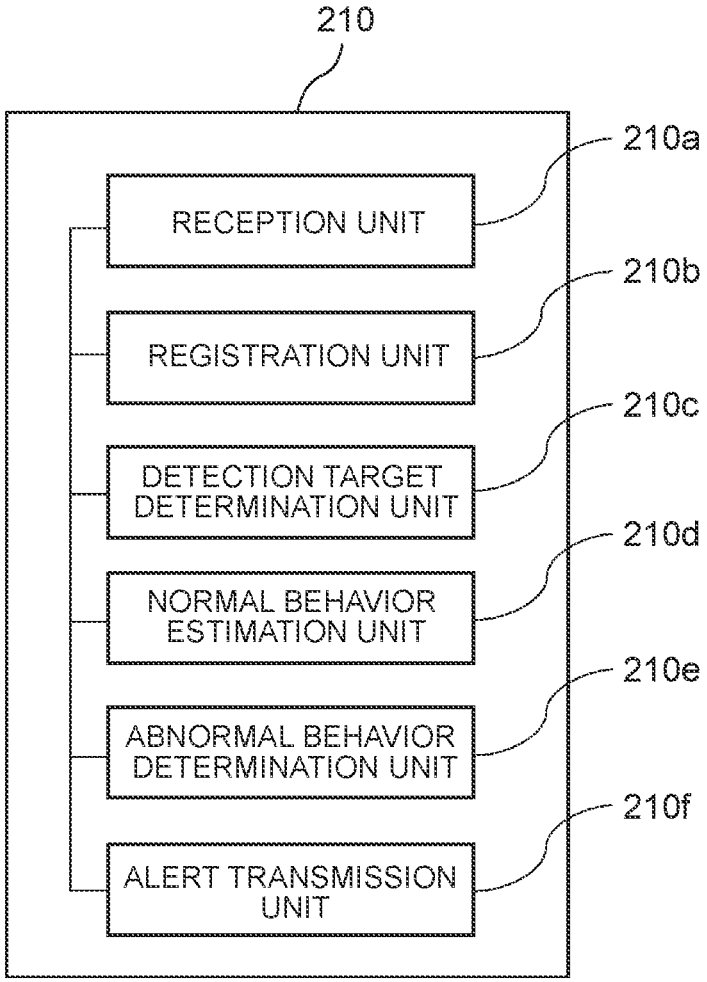
FIG. 4 is a schematic diagram showing a functional block of a control unit provided on the server.

FIG. 4 is a schematic diagram showing a functional block of the control unit 210 provided on the server 200. The control unit 210 of the server 200 includes a reception unit 210*a*, a registration unit 210*b*, a detection target determination unit 210*c*, a normal behavior estimation unit 210*d*, an abnormal behavior determination unit 210*e*, and an alert transmission unit 210*f*. Each of these units included in the control unit 210 is, for example, a functional module realized by a computer program operating on the control unit 210. That is, each of these units included in the control unit 210 is composed of the control unit 210 and a program (software) for operating the control unit 210. Further, the program may be recorded in the storage unit 230 of the server 200 or a recording medium connected from the outside. Alternatively, each of these units included in the control unit 210 may be a dedicated arithmetic circuit provided in the control unit 210.

The functional block of the control unit 210 of the server 200 shown in FIG. 4 may be provided in the control unit 110 of the mobile body 100. In other words, the mobile body 100 may have the function of the server 200 as the abnormal behavior notification device. In this case, the abnormal behavior notification system 1000 is composed of only the mobile body 100 and the user terminal 300.

The reception unit 210*a* of the control unit 210 receives, via the communication I/F 220, the image transmitted from the mobile body 100, the imaging time, the positioning information of the mobile body 100, and the internal parameters of the camera 140. Further, the reception unit 210*a* receives, via the communication I/F 220, the registration information related to the detection target transmitted from the user terminal 300.

The registration unit 210*b* of the control unit 210 registers the registration information related to the detection target received from the user terminal 300 in the storage unit 230. Specifically, the registration unit 210*b* registers the combination of the identification information for identifying the detection target and the normal behavior of the detection target in the storage unit 230. The identification information is information such as a vehicle number or a facial image of a person. When the detection target is a vehicle, the registration unit 210*b* registers the combination of the vehicle number and the normal behavior of the vehicle received from the user terminal 300. When the detection target is a person requiring long-term care or an elderly person, the registration unit 210*b* registers the combination of the facial image of the person and the normal behavior of the person received from the user terminal 300.

The normal behavior of the detection target is included in the registration information received from the user terminal 300. When the detection target is a vehicle, the registration unit 210*b* registers the normal behavior received from the user terminal 300, including the time zone in which the vehicle travels and the route in which the vehicle travels. When the detection target is a person requiring long-term care or an elderly person, the registration unit 210*b* registers the normal behavior received from the user terminal 300, including the time zone in which the person walks, the route, the presence or absence of a caregiver, and the like. Alternatively, the normal behavior of the detection target may be estimated by the server 200. In this case, the registration information received from the user terminal 300 does not have to include the normal behavior.

Every time the reception unit 210*a* receives the image from the mobile body 100, the detection target determination unit 210*c* of the control unit 210 determines whether the detection target is shown in the image captured by the mobile body 100 while the mobile body 100 moves, based on the identification information for identifying the detection target registered by the registration unit 210*b*.

Figure 5:
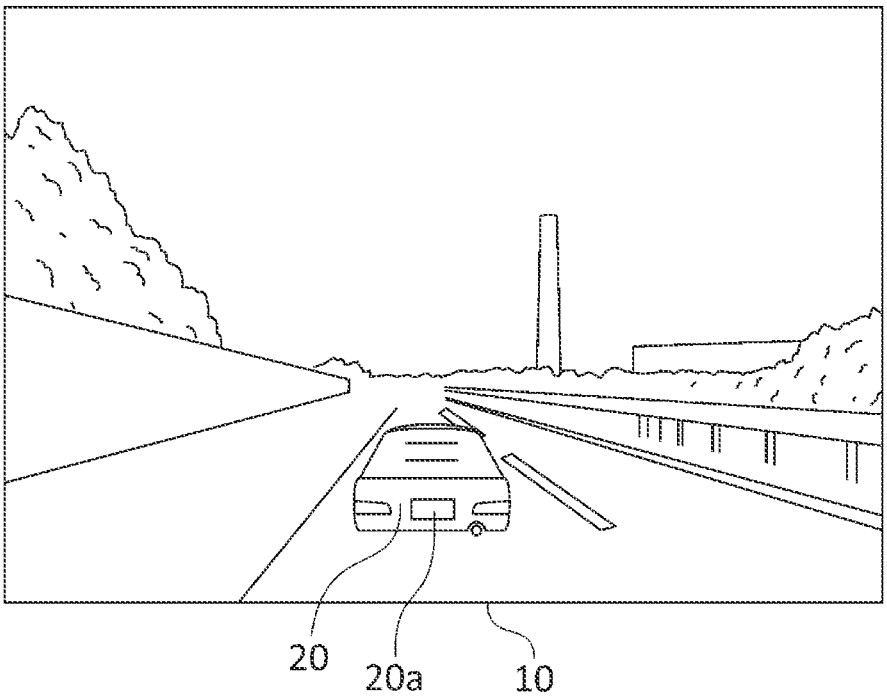
FIG. 5 is a schematic diagram showing a state in which it is determined whether a vehicle that is a detection target is shown in an image received from the mobile body, when the detection target is a vehicle.

FIG. 5 is a schematic diagram showing a state in which it is determined whether a vehicle that is a detection target is shown in an image 10 received from the mobile body 100 when the detection target is a vehicle. When the detection target is a vehicle, the detection target determination unit 210*c* determines, based on the vehicle number registered by the registration unit 210*b*, whether the image 10 received from the mobile body 100 includes a vehicle 20 having a number 20*a* matching the vehicle number. At this time, the vehicle number 20*a* is detected from the image 10 received from the mobile body 100, for example, by template matching between a template image showing the vehicle number and the image 10 received from the mobile body 100, or by inputting the image 10 into a machine-learned identifier for detecting the vehicle number. Then, using a technique such as feature point matching, it is determined whether the detected number 20*a* matches the vehicle number registered by the registration unit 210*b*. When the number 20*a* is detected from the image 10 and the number 20*a* matches the registered vehicle number, the detection target determination unit 210*c* determines that the vehicle 20 that is the detection target is shown in the image.

Figure 6:
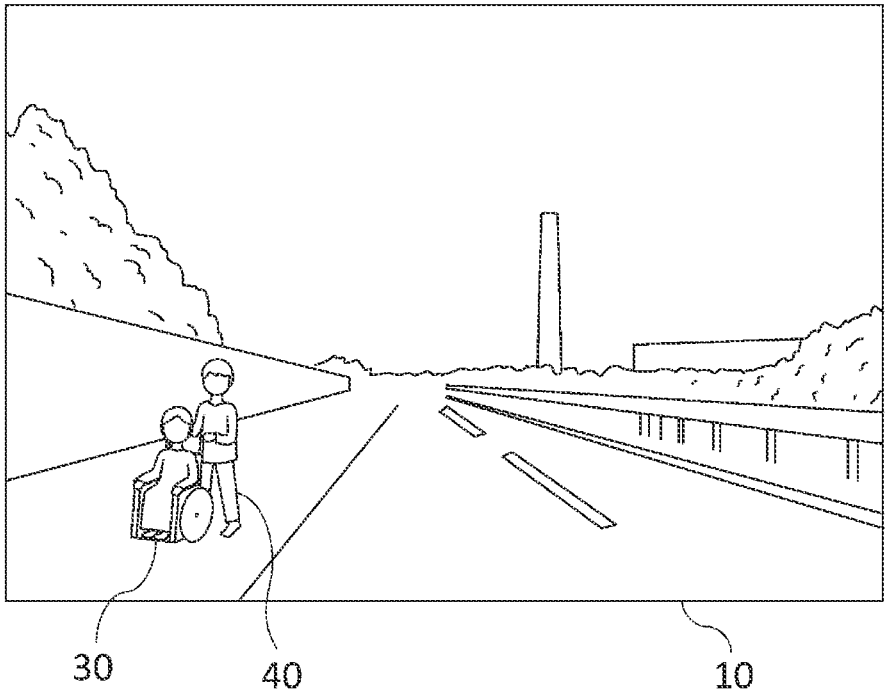
FIG. 6 is a schematic diagram showing a state in which it is determined whether a person certified as requiring long-term care that is a detection target is shown in an image received from the mobile body, when the detection target is a person certified as requiring long-term care.

FIG. 6 is a schematic diagram showing a state in which it is determined whether a person certified as requiring long-term care that is a detection target is shown in the image 10 received from the mobile body 100 when the detection target is a person certified as requiring long-term care. When the detection target is a person certified as requiring long-term care, the detection target determination unit 210*c* determines, based on the facial image of the person certified as requiring long-term care registered by the registration unit 210*b*, whether the image 10 received from the mobile body 100 includes a face matching the facial image. At this time, the face is detected from the image 10 received from the mobile body 100, for example, by template matching between a template image showing the face and the image 10 received from the mobile body 100, or by inputting the image 10 into a machine-learned identifier for detecting the face. Then, using a technique such as feature point matching, it is determined whether the detected face matches the facial image registered by the registration unit 210*b*. When the face is detected from the image 10 and the detected face matches the registered facial image, the detection target determination unit 210*c* determines that the person certified as requiring long-term care 30 that is the detection target is shown in the image 10. In FIG. 6, in addition to the person certified as requiring long-term care 30, a caregiver 40 who assists the person certified as requiring long-term care 30 is shown in the image 10.

For the above-mentioned identifier, the detection target determination unit 210*c* can use a segmentation identifier that outputs, for example, from the input image, the certainty that an object is represented by a pixel for each pixel of the image, for each type of object that may be represented by the pixel, and that has been trained in advance to identify that the object with the maximum certainty is represented. As such an identifier, the detection target determination unit 210*c* can use a deep neural network (DNN) having a convolutional neural network (CNN) architecture for segmentation such as fully convolutional network (FCN), for example. Alternatively, the detection target determination unit 210*c* may use a segmentation identifier based on another machine learning method such as random forest or support vector machine. In this case, the detection target determination unit 210*c* inputs an image into the segmentation identifier to identify a pixel in which a desired object appears in the image. The detection target determination unit 210*c* then sets a group of pixels in which the same type of object is shown as a region in which the object is represented.

As described above, the server 200 may estimate the normal behavior of the detection target. In this case, the normal behavior estimation unit 210*d* of the control unit 210 estimates the normal behavior of the detection target. From a plurality of images showing the detection target captured by the mobile body 100 in the past, the normal behavior estimation unit 210*d* identifies the position of the detection target when the images are captured, and estimates a predetermined movement route and a predetermined time zone in the normal behavior based on the specified position of the detection target and the imaging time of the images. When the detection target is a vehicle and the image includes a vehicle matching the vehicle number registered by the registration unit 210*b* based on the determination result of the detection target determination unit 210*c*, the normal behavior estimation unit 210*d* specifies the position of the vehicle with respect to the world coordinate system, based on the positioning information of the mobile body 100 when the image was captured, the position of the vehicle in the image (the position of the vehicle with respect to the camera coordinate system), and the internal parameters of the camera 140.

At this time, specifically, the normal behavior estimation unit 210*d* obtains a conversion formula that converts the camera coordinate system, which uses the position of the camera 140 of the mobile body 100 as the origin point and the optical axis direction of the camera 140 as one axial direction, into the world coordinate system. Such a conversion formula is represented by a combination of a rotation matrix representing rotation between the coordinate systems and a translation vector representing translation between the coordinate systems. The normal behavior estimation unit 210*d* converts the position of the vehicle included in the image shown by the camera coordinate system into coordinates in the world coordinate system according to the conversion formula. As a result, the position of the vehicle when the image is captured can be obtained. When the image includes a vehicle that matches the vehicle number registered by the registration unit 210*b*, the normal behavior estimation unit 210*d* may simply set the position of the mobile body 100 when the image is captured as the position of the vehicle.

Then, based on the plurality of types of the position information of the vehicle that is the detection target thus obtained and the imaging time of the images used to identify each position information, the normal behavior estimation unit 210*d* estimates the normal route and normal time zone in which the vehicle travels as the normal behavior of the vehicle.

Figure 7:
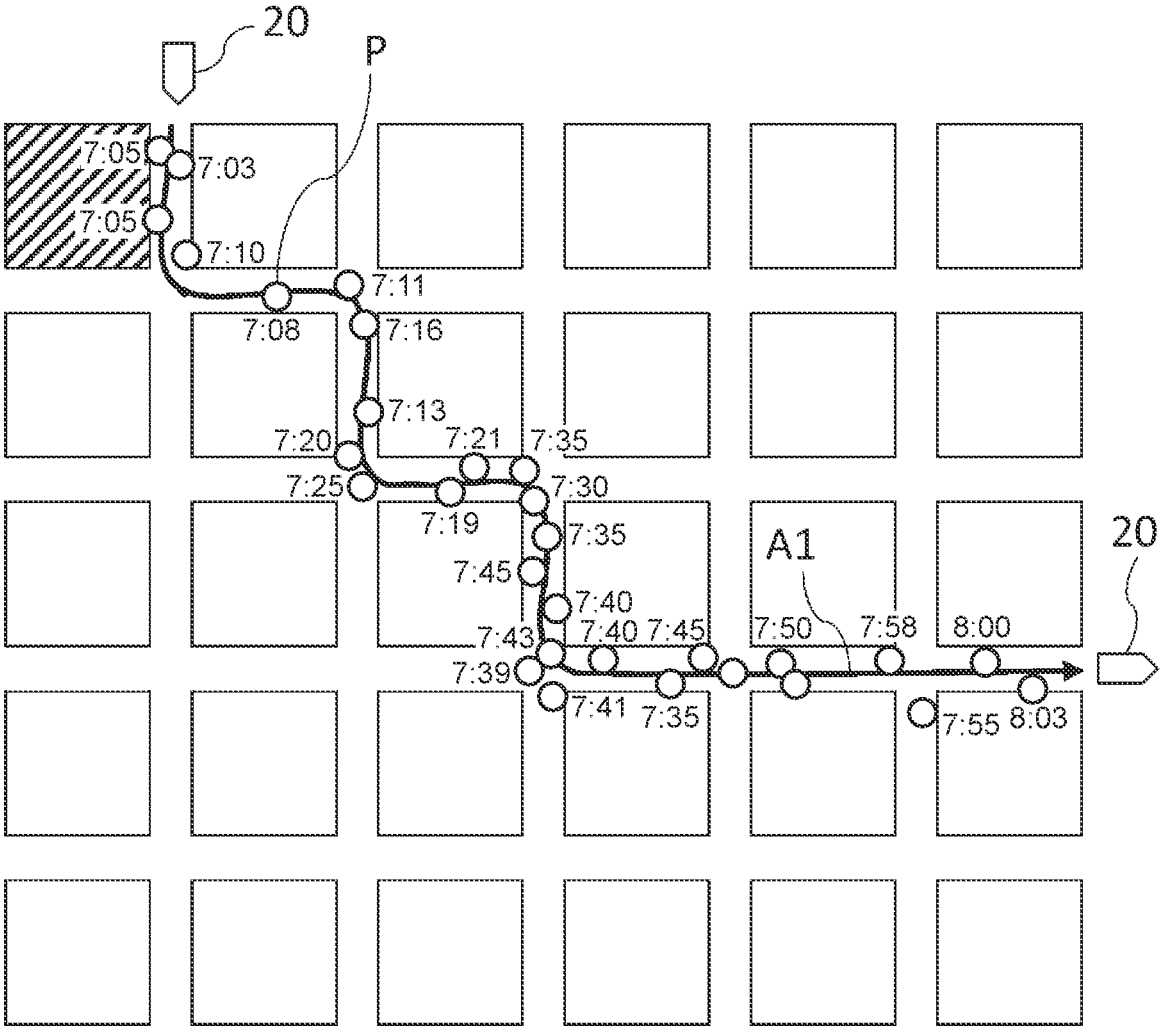
FIG. 7 is a schematic diagram showing a plurality of positions of a vehicle specified by a normal behavior estimation unit as a point cloud in a region in which roads are divided in a grid shape.

FIG. 7 is a schematic diagram showing a plurality of positions of the vehicle 20 specified by the normal behavior estimation unit 210*d* as a point cloud in a region in which roads are divided in a grid shape. As shown in FIG. 7, the position of the vehicle 20 indicated by the point P marked with a circle and the time at which the vehicle 20 exists at that position are associated with each other. The positions of the vehicle 20 shown in FIG. 7 are obtained from the result of specifying the position and time of the vehicle from the images captured by the camera of the mobile body 100 during a predetermined period (for example, one month, half a year, one year, etc.).

In the example shown in FIG. 7, the vehicle 20 travels on the route A1 indicated by the arrow A1 between about 7:00 am and 8:00 am. Therefore, the normal behavior estimation unit 210*d* estimates that the normal behavior of the vehicle 20 is to travel on the route A1 in the time zone from 7:00 am to 8:00 am.

Figure 8:
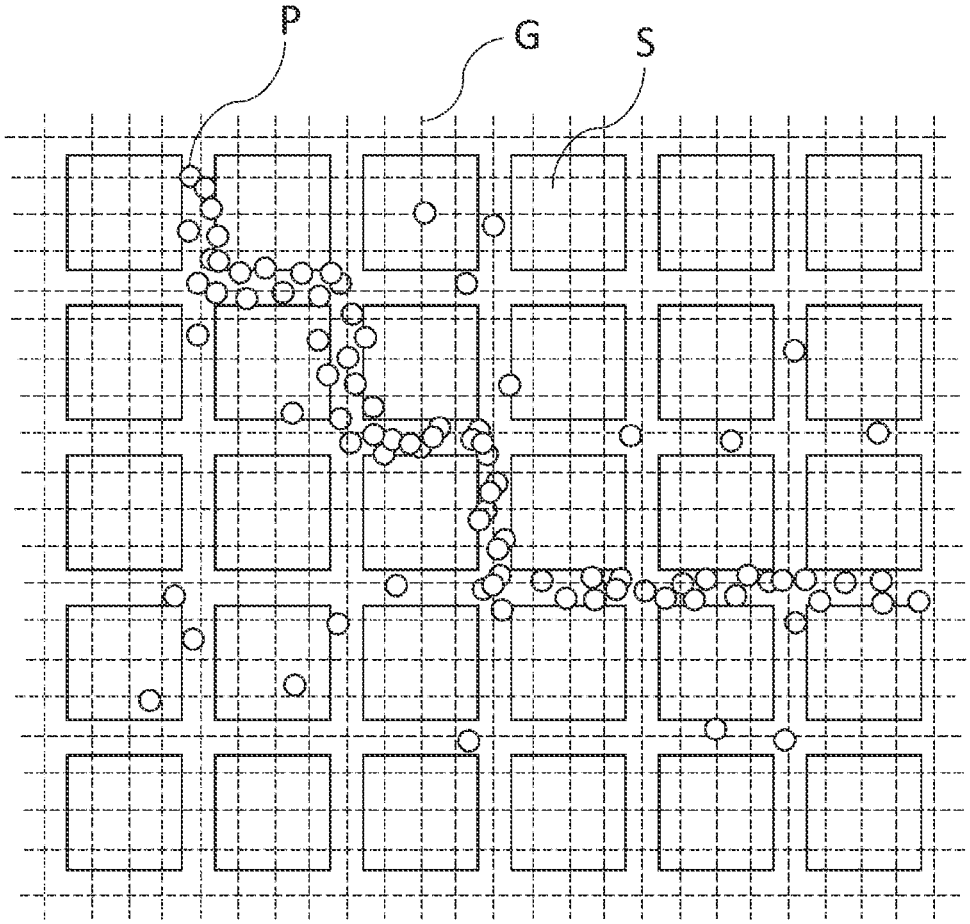
FIG. 8 is a diagram showing an example of a method in which the normal behavior estimation unit estimates normal behavior of a vehicle by using rule-based estimation.

More specifically, the normal behavior estimation unit 210*d* estimates the normal route and time zone in which the vehicle travels, for example, by rule-based estimation or estimation using machine learning. FIG. 8 is a diagram showing an example of a method in which the normal behavior estimation unit 210*d* estimates the normal behavior of the vehicle by using rule-based estimation. FIG. 8 shows a state in which the region shown in FIG. 7 is divided by broken grid lines G. The region shown in FIG. 8 is divided into a plurality of square small regions S by the grid lines G.

In the rule-based estimation, for example, based on the probability that a point P indicating the specified position of the vehicle exists in each small region S, a set of the small regions S having an existence probability of a predetermined value or more is estimated as the normal vehicle route. The existence probability is represented by, for example, the number of points P existing in each small region S within the period (for example, one month, half a year, one year, etc.) in which the position information (point P) of the vehicle is collected. Further, the time range corresponding to the points P included in the small regions S with the existence probability of equal to or more than the predetermined value is estimated as the normal time zone.

Figure 9:
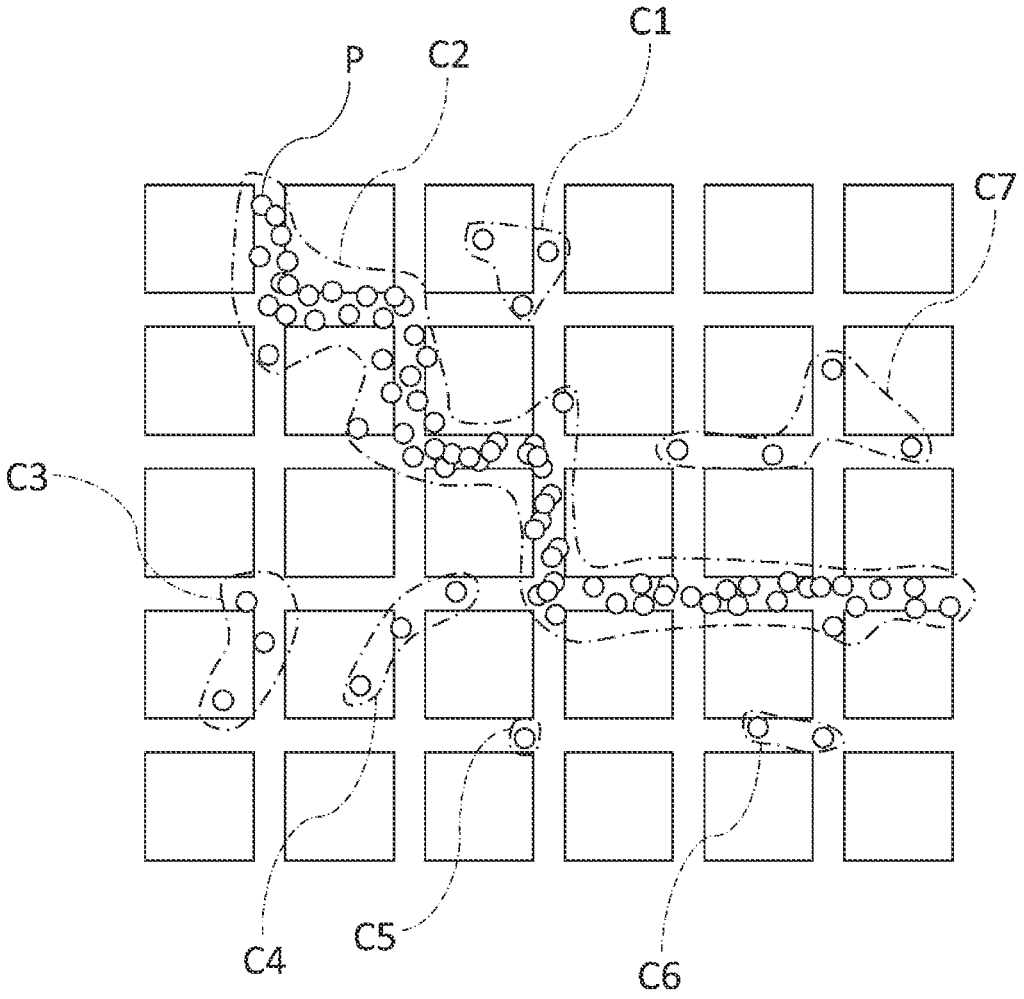
FIG. 9 is a diagram showing an example of a method in which the normal behavior estimation unit estimates the normal behavior of the vehicle by using machine learning.

FIG. 9 is a diagram showing an example of a method in which the normal behavior estimation unit 210*d* estimates the normal behavior of a vehicle by using machine learning. In the estimation using machine learning, for example, the vehicle position information (point P) is classified by clustering, and the cluster that has the best number of clusters on the dendrogram, or the cluster in which the distance between the clusters on the dendrogram is a predetermined value or more (or falls within a specified range) is extracted. FIG. 9 shows seven clusters C1 to C7 obtained by clustering for a point cloud consisting of the same group of points P as in FIG. 8. Among the clusters thus obtained, the largest cluster, that is, the cluster C2 to which the most points P belong is estimated as the normal vehicle route. Further, the time range corresponding to the points P included in the cluster C2 is estimated as the normal time zone. The clustering may be performed for the time with the same method.

As for the number of points P, it is only necessary that a predetermined number necessary for estimating the normal behavior by rule-based estimation or estimation using machine learning is collected, and the predetermined number is, for example, 100. In the case of machine learning, in order to suppress harmful effects of overlearning, learning with more than a predetermined number of point clouds may be avoided.

Further, when an alert is transmitted to the user terminal 300 and the cancel button of the user terminal 300, which will be described later, is pressed, causing the user terminal 300 to transmit that the alert is unnecessary, the normal behavior estimation unit 210*d* may perform learning excluding the position and time of the detection target that is the source of the alert.

Also when the detection target is a person certified as requiring long-term care or an elderly person, the normal behavior estimation unit 210*d* uses the same method as when the detection target is a vehicle, and the normal route and time zone when the person moves are estimated as the normal behavior. In particular, it may be difficult for the user to grasp the normal behavior of a person who may wander about, and thus the normal behavior cannot be transmitted to the user terminal 300. In some embodiments, the normal behavior is estimated on the server 200 side.

Further, when the detection target corresponding to the identification information is included in the image based on the determination result of the detection target determination unit 210*c*, the normal behavior estimation unit 210*d* may estimate the normal behavior of the detection target from the state of the detection target shown in the image. For example, when the detection target shown in FIG. 6 is the person certified as requiring long-term care 30 and, based on a plurality of images captured by the camera of the mobile body 100 for a predetermined period (for example, one month, half a year, one year, etc.), the person certified as requiring long-term care 30 is shown in the image and another person is shown within a predetermined distance (for example, within 1 m) from the person certified as requiring long-term care 30, the normal behavior estimation unit 210*d* estimates that the normal behavior of the person certified as requiring long-term care 30 is to act with the other person. Further, for example, when the detection target is a user's home gate and the home gate is closed based on a plurality of images captured by the camera of the mobile body 100 for a predetermined period, the normal behavior estimation unit 210*d* estimates that the normal behavior of the home gate is to be closed.

The normal behavior of the detection target estimated by the normal behavior estimation unit 210*d* as described above may be registered in the storage unit 230 by the registration unit 210*b* together with the identification information of the detection target. Alternatively, the normal behavior of the detection target estimated by the normal behavior estimation unit 210*d* may not be registered, and the configuration may be such that when images serving as the source of the estimation are acquired, the normal behavior is sequentially updated based on these images.

The abnormal behavior determination unit 210*e* of the control unit 210 determines whether the detection target exhibits an abnormal behavior based on the combination of the identification information for identifying the detection target registered by the registration unit 210*b* and the normal behavior of the detection target, and the images received by the reception unit 210*a* from the mobile body 100. With the normal behavior of the detection target being that the detection target moves in a predetermined movement route and a predetermined time zone, when the position of the detection target based on the position of the mobile body 100 when the image showing the detection target is captured is not included in the predetermined movement route, or the time at which the image showing the detection target is captured is not included in the predetermined time zone, the abnormal behavior determination unit 210*e* determines that the detection target exhibits an abnormal behavior that is different from the normal behavior.

More specifically, when the image includes the detection target corresponding to the identification information registered by the registration unit 210*b* based on the determination result of the detection target determination unit 210*c*, the abnormal behavior determination unit 210*e* specifies the position of the detection target with respect to the world coordinate system, based on the positioning information of the mobile body 100 when the image was captured, the position of the detection target in the image (the position of the detection target with respect to the camera coordinate system), and the internal parameters of the camera 140. Then, the abnormal behavior determination unit 210*e* compares the position of the detection target thus obtained and the time at which the image including the detection target was captured, with the route and time zone in the normal behavior of the detection target. When the position of the detection target is not included in the route of the normal behavior or when the time at which the image showing the detection target was captured is not included in the time zone of the normal behavior, the abnormal behavior determination unit 210*e* determines that the behavior of the detection target is abnormal.

It should be noted that the abnormal behavior determination unit 210*e* may determine that the behavior of the detection target is abnormal when the position of the detection target is not included in the route of the normal behavior and when the time at which the image showing the detection target was captured is not included in the time zone of the normal behavior.

For example, when the detection target is a vehicle owned by the user and the image includes a vehicle matching the vehicle number registered by the registration unit 210*b* based on the determination result of the detection target determination unit 210*c*, the abnormal behavior determination unit 210*e*, as in the normal behavior estimation unit 210*d*, specifies the position of the vehicle with respect to the world coordinate system, based on the positioning information of the mobile body 100 when the image was captured, the position of the vehicle in the image (the position of the vehicle with respect to the camera coordinate system), and the internal parameters of the camera 140. Then, the abnormal behavior determination unit 210*e* compares the position of the vehicle thus obtained and the time at which the image including the vehicle was captured, with the route and time zone in the normal behavior of the vehicle.

Figure 10:
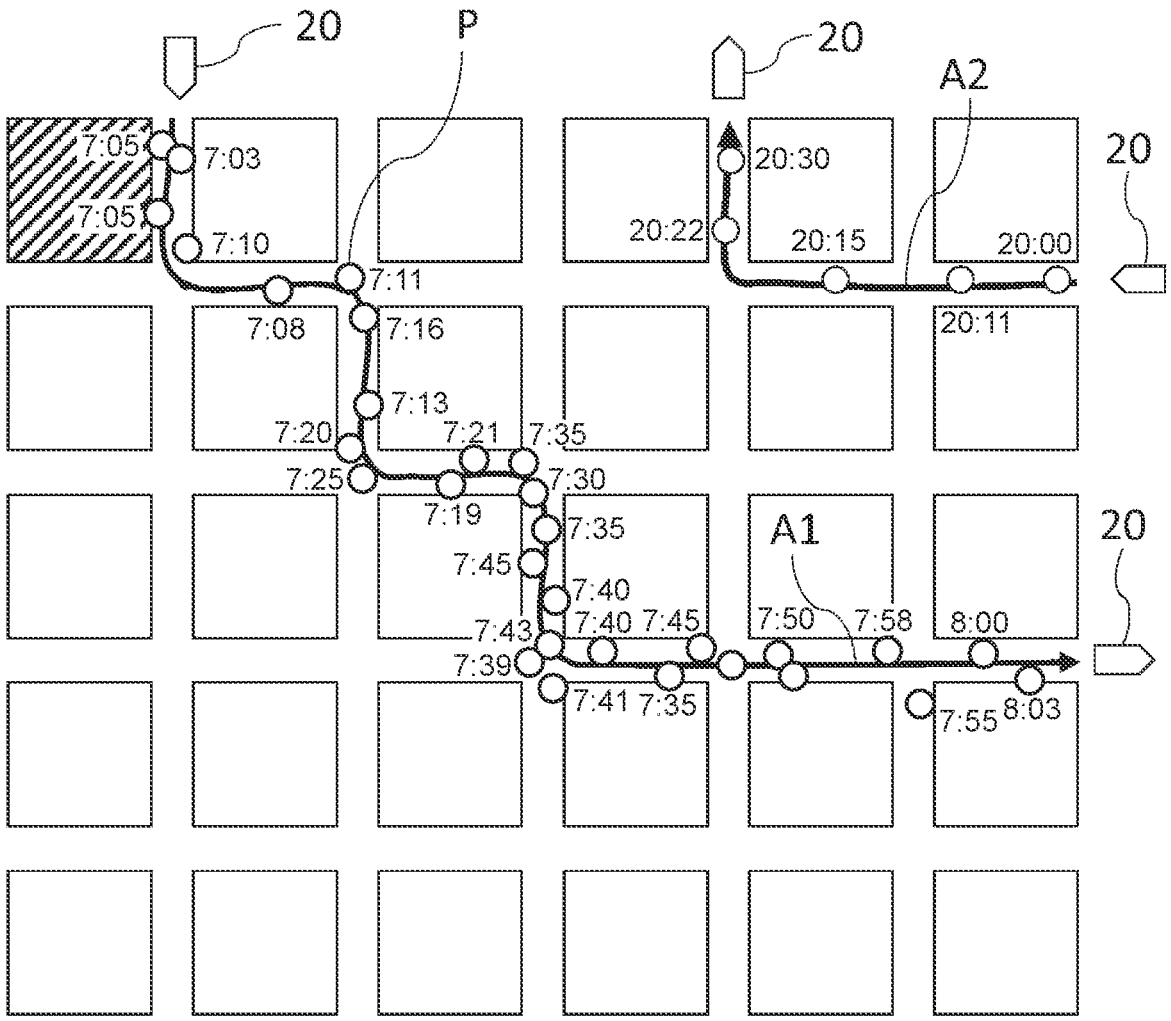
FIG. 10 is a schematic diagram showing a case where the vehicle exhibits an abnormal behavior with respect to the normal behavior of the vehicle shown in FIG. 7.

FIG. 10 is a schematic diagram showing a case where the vehicle exhibits an abnormal behavior with respect to the normal behavior of the vehicle shown in FIG. 7. FIG. 10 shows that the vehicle 20 travels on the route A2 between 8:00 pm and 8:30 pm. Since the behavior of the vehicle 20 traveling on the route A2 between 8:00 pm and 8:30 pm is different from the normal behavior in which the vehicle 20 travels on the route A1 in the time zone from 7:00 am to 8:00 am, the abnormal behavior determination unit 210*e* determines that the behavior of the vehicle 20 traveling on the route A2 between 8:00 pm and 8:30 pm is abnormal.

It should be noted that the abnormal behavior determination unit 210*e* may determine whether the position of the detection target is included in the route of the normal behavior based on a region obtained by expanding the width of the route of the normal behavior. For example, when the route of the normal behavior registered by the user is the route A1 shown in FIGS. 7 and 10, it may be determined whether the position of the detection target is included in the route of the normal behavior depending on whether the position of the detection target is included in a region obtained by offsetting the route A1 to the right and left by a predetermined amount. Similarly, for the time zone, the abnormal behavior determination unit 210*e* may determine whether the imaging time of the image showing the detection target is included in the time zone of the normal behavior depending on whether the imaging time of the image showing the detection target is included in a time zone obtained by expanding the time zone of the normal behavior by a predetermined ratio.

Further, when the detection target corresponding to the identification information is included in the image and the state of the detection target shown in the image is different from the state of the normal behavior registered by the registration unit 210*b*, the abnormal behavior determination unit 210*e* determines that the behavior of the detection target is abnormal. For example, in the case where the detection target is a specific person and the normal behavior is that this specific person is accompanied by an attendant, when the specific person is shown in the image and the same other person is not shown in the image continuously for a predetermined time or more within a predetermined distance from the specific person, the abnormal behavior determination unit 210*e* determines that the specific person exhibits an abnormal behavior that is different from the normal behavior.

Figure 11:
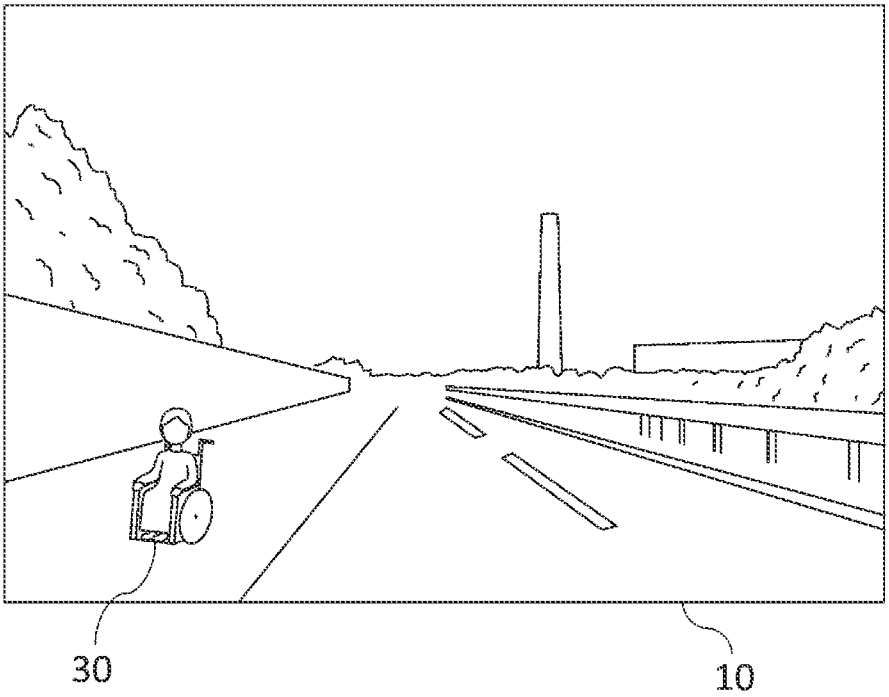
FIG. 11 is a schematic diagram showing a state in which an abnormal behavior determination unit determines that the state of the person certified as requiring long-term care shown in the image indicates an abnormal behavior that is different from the state of normal behavior, when the person certified as requiring long-term care that is the detection target is shown in the image.

FIG. 11 is a schematic diagram showing a state in which the abnormal behavior determination unit 210*e* determines that, when the person certified as requiring long-term care 30 that is the detection target is shown in the image 10, the state of the certified person requiring long-term care 30 shown in the image indicates an abnormal behavior that is different from the state of the normal behavior. When the person certified as requiring long-term care 30 is shown in the image 10 based on the determination result of the detection target determination unit 210*c*, the abnormal behavior determination unit 210*e* compares the state of the person certified as requiring long-term care 30 in the image 10 with the registered state of the normal behavior of the person certified as requiring long-term care 30. When the state of the person certified as requiring long-term care 30 in the image 10 is different from the state of the normal behavior, the abnormal behavior determination unit 210*e* determines that the behavior of the person certified as requiring long-term care 30 is abnormal.

When the state of the normal behavior of the person certified as requiring long-term care 30 registered by the registration unit 210*b* is that the person certified as requiring long-term care 30 acts together with the caregiver 40 as shown in FIG. 6, the abnormal behavior determination unit 210*e* determines whether the same other person exists continuously for a predetermined time (for example, about 5 minutes) or more within a predetermined distance (for example, about 1 m) from the person certified as requiring long-term care 30 shown in the image 10. The determination is made, for example, by detecting a person beside the person certified as requiring long-term care 30 by template matching between a template image showing a person and the image 10 received from the mobile body 100, or by inputting the image 10 into a machine-learned identifier for human detection to determine whether the same other person exists for a predetermined time or more within a predetermined distance from the person certified as requiring long-term care 30 by face recognition based on the image. When the same other person does not exist continuously for a predetermined time or more within a predetermined distance from the person certified as requiring long-term care 30 as shown in FIG. 11, since the caregiver 40 that has been registered as the normal behavior does not exist, the abnormal behavior determination unit 210*e* determines that the behavior of the person certified as requiring long-term care 30 is abnormal.

In contrast, when the same other person (caregiver 40) exists continuously for a predetermined time or more within a predetermined distance from the person certified as requiring long-term care 30 as shown in FIG. 6, the abnormal behavior determination unit 210*e* determines that the behavior of the person certified as requiring long-term care 30 is normal. The abnormal behavior determination unit 210*e* may simply determine that the behavior of the person certified as requiring long-term care 30 is abnormal when no other person exists within a predetermined distance from the person certified as requiring long-term care 30.

When the abnormal behavior determination unit 210*e* determines an abnormal behavior of the detection target, the alert transmission unit 210*f* of the control unit 210 transmits an alert to the user terminal 300 that has transmitted the registration information related to the detection target. The alert transmission unit 210*f* may transmit the latest position information of the detection target that has been determined to have exhibited the abnormal behavior together with the alert.

In the example of FIG. 10, when the abnormal behavior determination unit 210*e* determines that the behavior of the vehicle 20 traveling on the route A2 between 8:00 pm and 8:30 pm is abnormal, the abnormal behavior determination unit 210*e* transmits an alert to the user terminal 300 that has transmitted the number of the vehicle 20 as the registration information. Further, in the example of FIG. 11, when the abnormal behavior determination unit 210*e* determines that the behavior of the person certified as requiring long-term care 30 who is not accompanied by the same other person continuously for a predetermined time or more within a predetermined distance is abnormal, the abnormal behavior determination unit 210*e* transmits an alert to the user terminal 300 that has transmitted the facial image of the person certified as requiring long-term care 30 as the registration information.

When the user owning the user terminal 300 to which the alert is transmitted receives the alert, the user recognizes that the registered detection target exhibits an abnormal behavior that is different from usual. When the abnormal behavior is a behavior that the user does not know in advance, the user can take appropriate actions for the abnormal behavior. For example, when the detection target is a vehicle, it is conceivable that the vehicle has been stolen and the thief is driving the vehicle in a time zone or route different than usual. Therefore, the user who has received the alert can take appropriate measures such as calling the police.

On the other hand, the user owning the user terminal 300 to which the alert is transmitted can cancel the alert when the abnormal behavior is a behavior that the user knows in advance. For example, in the example of FIG. 10, when the user lends the vehicle 20 to a family member or a friend and knows in advance that the vehicle 20 will travel on the route A2 between 8:00 pm and 8:30 pm, the alert is canceled.

Figure 12:
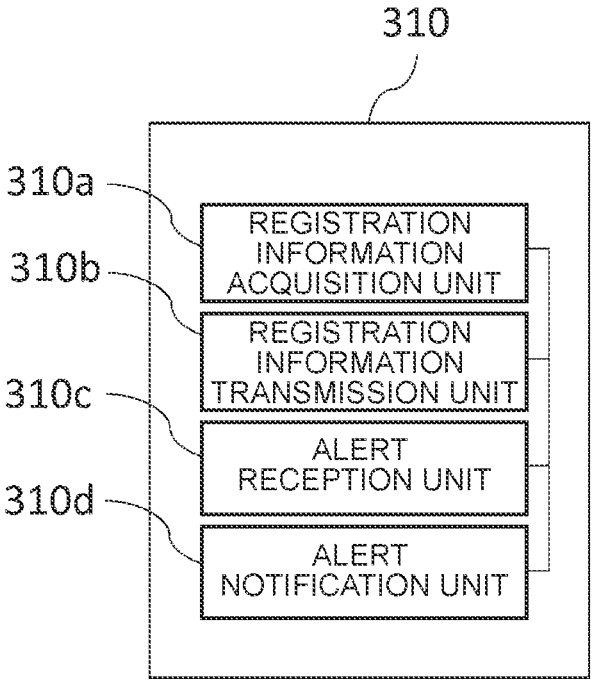
FIG. 12 is a schematic diagram showing a functional block of the control unit provided on the user terminal.

FIG. 12 is a schematic diagram showing a functional block of the control unit 310 provided on the user terminal 300. The control unit 310 of the user terminal 300 includes a registration information acquisition unit 310*a*, a registration information transmission unit 310*b*, an alert reception unit 310*c*, and an alert notification unit 310*d*. Each of these units included in the control unit 310 is, for example, a functional module realized by a computer program operating on the control unit 310. That is, each of these units included in the control unit 310 is composed of the control unit 310 and a program (software) for operating the control unit 310. Further, the program may be recorded in the storage unit 330 of the user terminal 300 or a recording medium connected from the outside. Alternatively, each of these units included in the control unit 310 may be a dedicated arithmetic circuit provided in the control unit 310.

The registration information acquisition unit 310*a* of the control unit 310 acquires the registration information related to the detection target, which is input by the user by operating the input unit 350. As described above, the registration information related to the detection target includes the identification information for identifying the detection target and the normal behavior of the detection target. As described above, the identification information is, for example, information on the license plate of the vehicle when the detection target is a vehicle, and is a facial image when the detection target is a person certified as requiring long-term care or an elderly person.

When the identification information is a facial image, the registration information acquisition unit 310*a* acquires, as the identification information, an image showing the face of a person obtained by the user by capturing an image of a person certified as requiring long-term care or an elderly person with the camera 360 of the user terminal 300, for example.

The registration information transmission unit 310*b* of the control unit 310 performs a process of transmitting, to the server 200 via the communication I/F 320, the registration information acquired by the registration information acquisition unit 310*a*.

Figure 13:
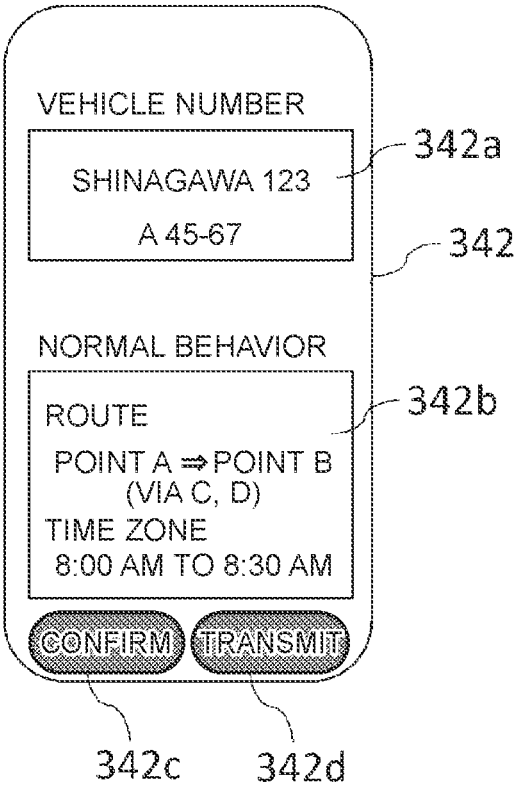
FIG. 13 is a schematic diagram showing an example of a display screen of a display unit when a user operates an input unit to input and transmit registration information related to the detection target, in the case where the user terminal is a smartphone having a touch panel.

FIG. 13 is a schematic diagram showing an example of a display screen 342 of the display unit 340 when a user operates the input unit 350 to input the registration information related to the detection target and transmit the information to the server 200, in the case where the user terminal 300 is a smartphone having a touch panel. FIG. 13 shows a case where a vehicle number is input as the identification information for identifying the detection target and transmitted to the server 200. As shown in FIG. 13, by operating the touch panel on the display screen 342, the user inputs the vehicle number in an input field 342*a* and inputs the normal behavior (route and time zone) of the detection target in an input field 342*b*. After inputting these types of information, when the user presses a confirmation button 342*c*, the registration information acquisition unit 310*a* acquires the license plate information of the vehicle input in the input field 342*a* as the identification information for identifying the detection target, and acquires the normal behavior of the vehicle input in the input field 342*b*.

Then, when the user presses a transmission button 342*d*, the registration information transmission unit 310*b* transmits the vehicle number and the normal behavior to the server 200. In the example shown in FIG. 13, when the normal behavior estimation unit 210*d* of the server 200 estimates the normal behavior of the detection target, the user does not need to input the normal behavior. In this case, the normal behavior is not transmitted to the server 200, and only the vehicle number, which is the identification information, is transmitted to the server 200.

Figure 14:
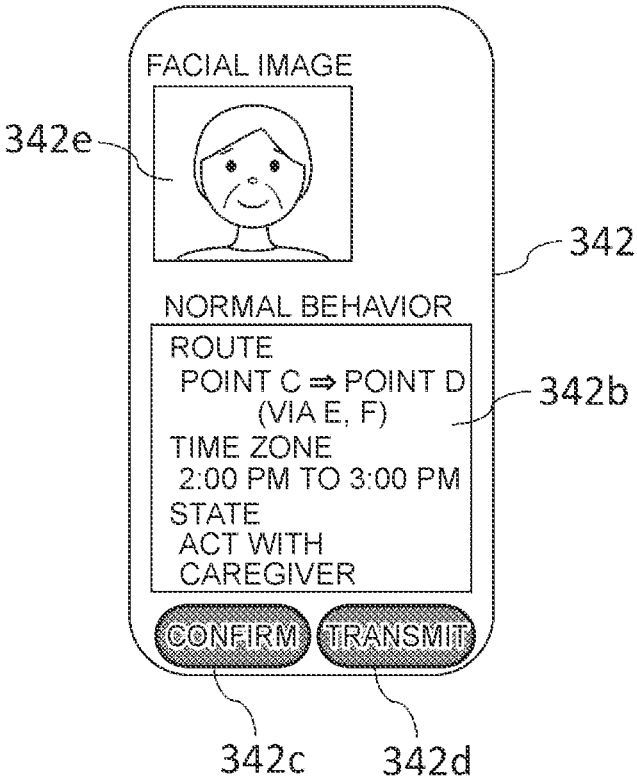
FIG. 14 is a schematic diagram showing another example of the display screen of the display unit when the user operates the input unit to transmit information related to the detection target, in the case where the user terminal is the smartphone having the touch panel.

FIG. 14 is a schematic diagram showing another example of the display screen 342 of the display unit 340 when a user operates the input unit 350 to input the registration information related to the detection target and transmit the information to the server 200, in the case where the user terminal 300 is a smartphone having a touch panel. FIG. 14 shows a case where a facial image is transmitted as the identification information for identifying the detection target, when the detection target is a person certified as requiring long-term care. By operating the touch panel, the user selects a facial image of a person certified as requiring long-term care or an elderly person that is the detection target from the images captured by the camera 360 of the user terminal 300, and causes the display screen 342 to display the image in an input field 342*e*. The images captured by the camera 360 are stored in advance in the storage unit 330 of the user terminal 300. The user inputs the normal behavior of the detection target to the input field 342*b*. In the example shown in FIG. 14, as the normal behavior of the detection target, in addition to the route and time zone, information that the person certified as requiring long-term care acts with the caregiver is input in the state column. After inputting these types of information, when the user presses the confirmation button 342*c*, the registration information acquisition unit 310*a* acquires the facial image of the person certified as requiring long-term care input in the input field 342*e* as the identification information for identifying the detection target, and acquires the normal behavior of the person certified as requiring long-term care input in the input field 342*b*. Then, when the user presses the transmission button 342*d*, the registration information transmission unit 310*b* transmits the facial image of the person certified as requiring long-term care and the normal behavior to the server 200.

The alert reception unit 310*c* of the control unit 310 receives, via the communication I/F 320, the alert transmitted from the server 200. When the latest position information of the detection target is transmitted from the server 200 together with the alert, the alert reception unit 310*c* receives the latest position information of the detection target.

The alert notification unit 310*d* of the control unit 310 performs a process for notifying the user of the alert received by the alert reception unit 310*c*. Specifically, the alert notification unit 310*d* performs a process of displaying the alert on the display unit 340 or a process of outputting the alert by voice from the speaker 370.

Figure 15:
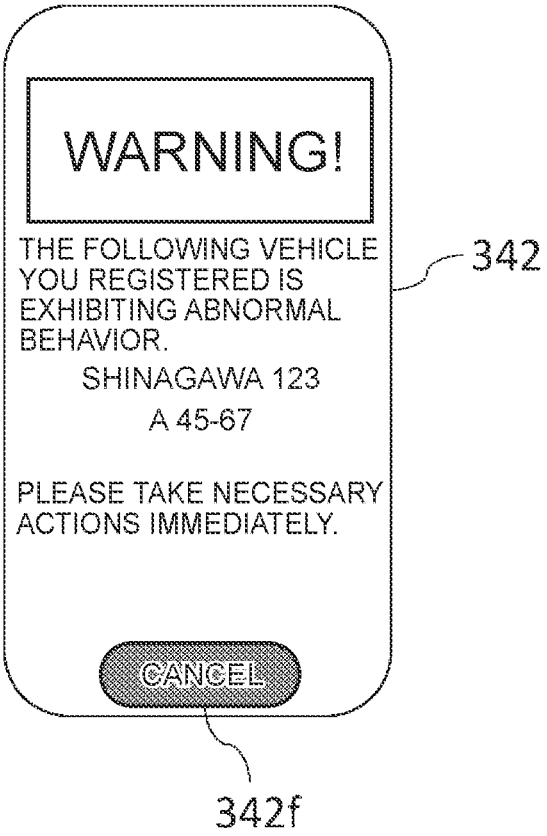
FIG. 15 is a schematic diagram showing an example of an alert displayed on the display screen of the display unit of the user terminal.

FIG. 15 is a schematic diagram showing an example of an alert displayed on the display screen 342 of the display unit 340 of the user terminal 300. In the example shown in FIG. 15, an alert indicating that a vehicle exhibits an abnormal behavior is displayed, when the detection target registered by the user is a vehicle owned by the user. Based on the displayed alert, the user can confirm the location of the vehicle owned by the user and take actions such as calling the police if necessary. The warning may include the latest position information of the vehicle transmitted from the server 200. In that case, the latest position information of the vehicle is displayed on the display screen 342 together with the alert.

When the user who has been notified of the alert has expected the behavior of the vehicle and the displayed alert is not fundamentally required, the user can cancel the alert by pressing a button 342*f* for canceling the alert. When the alert is canceled, a message indicating the cancellation is sent to the server 200.

Figure 16:
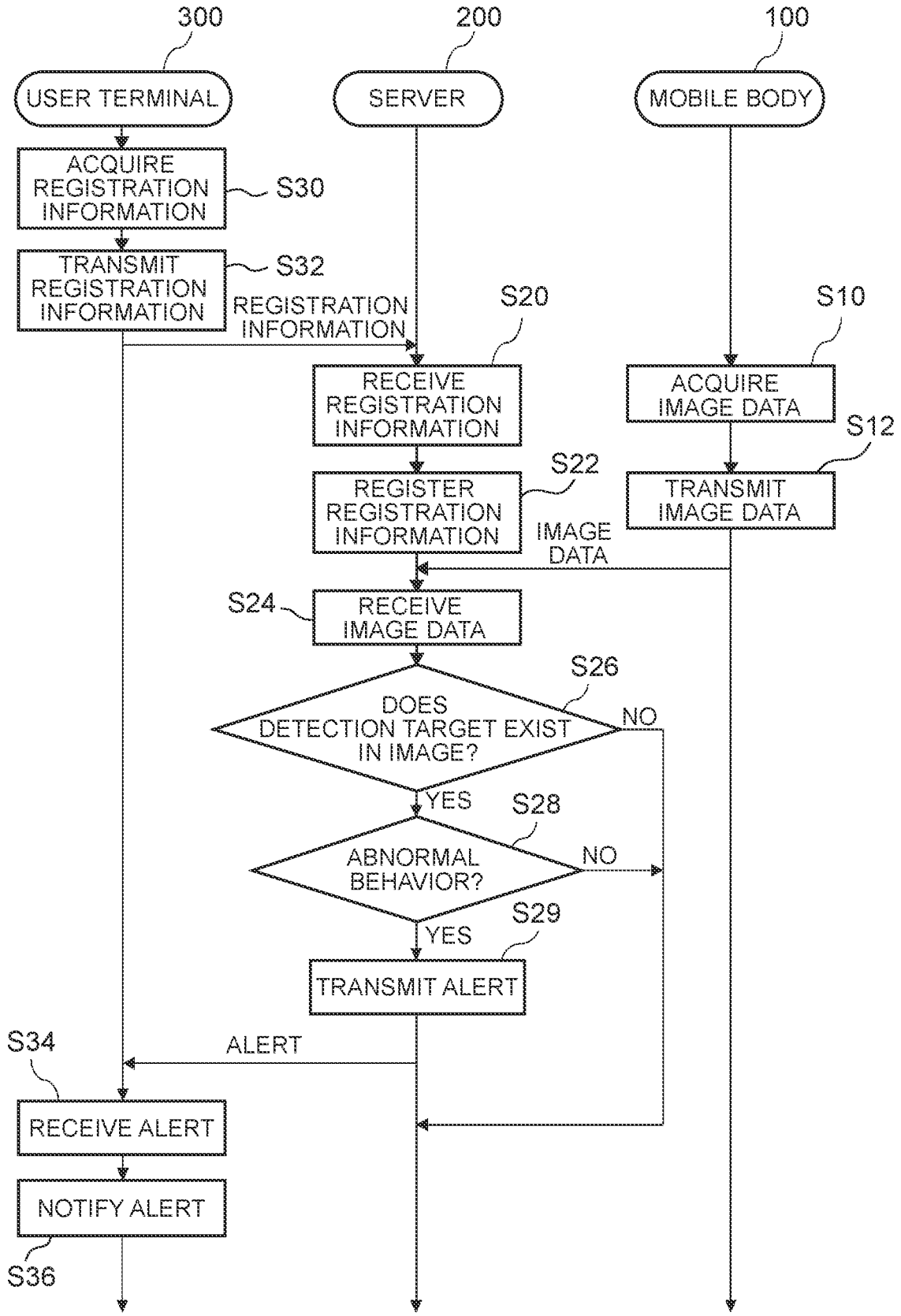
FIG. 16 is a sequence diagram showing a process performed by the mobile body, the server, and the user terminal.

FIG. 16 is a sequence diagram showing a process performed by the mobile body 100, the server 200, and the user terminal 300. FIG. 16 shows a case where the normal behavior of the detection target is included in the registration information transmitted from the user terminal 300. First, the registration information acquisition unit 310*a* of the control unit 310 of the user terminal 300 acquires the registration information related to the detection target that has been input by the user by operating the input unit 350 (step S30). Next, the registration information transmission unit 310*b* of the control unit 310 transmits the registration information acquired by the registration information acquisition unit 310*a* to the server 200 (step S32).

Consequently, the reception unit 210*a* of the control unit 210 of the server 200 receives the registration information related to the detection target transmitted from the user terminal 300 (step S20). Next, the registration unit 210*b* of the control unit 210 registers the registration information related to the detection target received from the user terminal 300 in the storage unit 230 (step S22). In this way, the identification information for identifying the detection target for which the user desires to detect the abnormal behavior and the normal behavior of the detection target are registered in the server 200.

When the camera 140 of the mobile body 100 captures images of the surroundings of the mobile body 100, the image acquisition unit 110*a* of the control unit 110 of the mobile body 100 acquires the image data generated by the camera 140 (step S10). Then, the transmission unit 110*b* of the control unit 110 transmits the image data acquired by the image acquisition unit 110*a* to the server 200 (step S12). The transmission unit 110*b* transmits information such as the imaging time at which the image was captured, the positioning information of the mobile body 100 when the image was captured, and the internal parameters of the camera 140 to the server 200 together with the image data.

The reception unit 210*a* of the control unit 210 of the server 200 receives the image data transmitted from the mobile body 100, and also receives the information such as the imaging time, the positioning information of the mobile body 100, and the internal parameters of the camera 140 (step S24). Next, the detection target determination unit 210*c* of the control unit 210 determines whether the detection target exists in the image received from the mobile body 100 (step S26), and when the detection target exists, the abnormal behavior determination unit 210*e* determines whether the behavior of the detection target is an abnormal behavior different than usual (step S28) based on the normal behavior of the detection target registered in the storage unit 230. When the behavior of the detection target is an abnormal behavior different than usual, the alert transmission unit 210*f* of the control unit 210 transmits an alert to the user terminal 300 (step S29).

The alert reception unit 310*c* of the control unit 310 of the user terminal 300 receives the alert transmitted from the server 200 (step S34). Subsequently, the alert notification unit 310*d* of the control unit 310 notifies the user of the alert received by the alert reception unit 310*c* (step S36). As a result, the alert is displayed on the display unit 340, and the alert is output by voice from the speaker 370.

Figure 17:
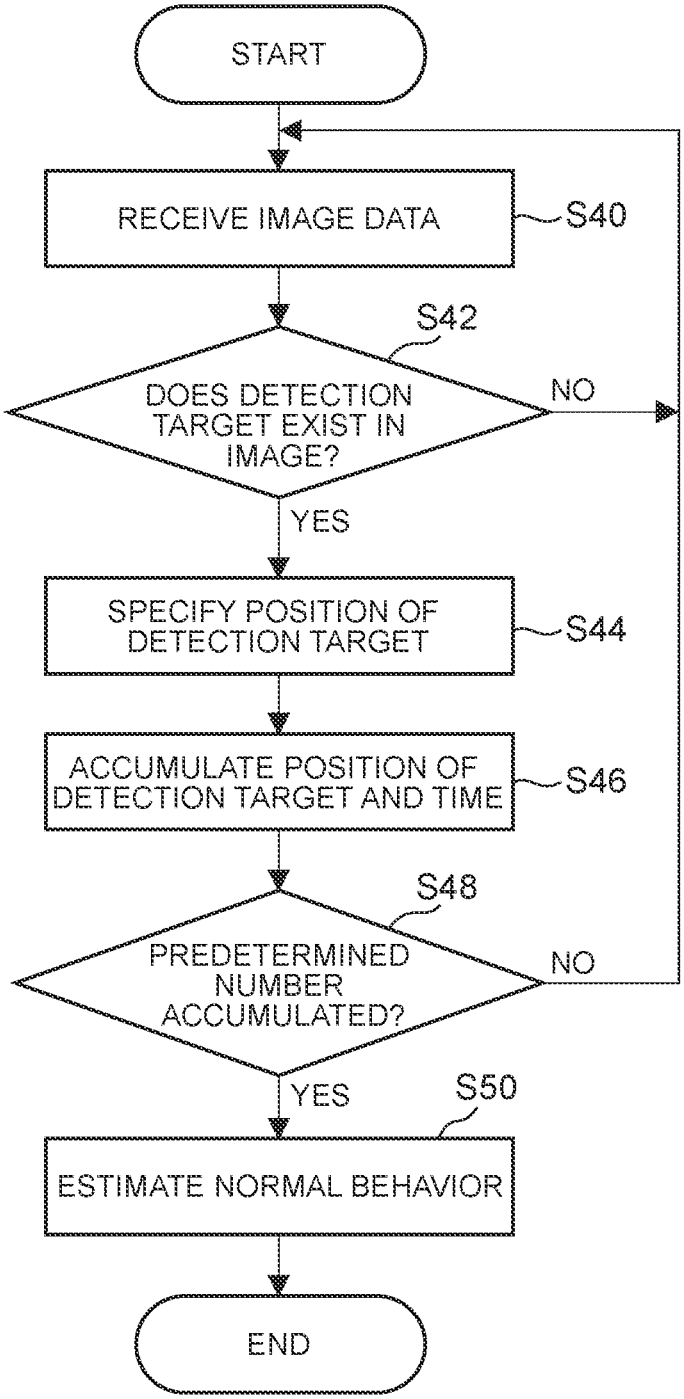
FIG. 17 is a flowchart showing a process when the server estimates the normal behavior of the detection target.

In FIG. 16, since the normal behavior of the detection target is included in the registration information transmitted from the user terminal 300, the identification information and the normal behavior received by the server 200 from the user terminal 300 are registered in step S22. Alternatively, in step S22, the normal behavior of the detection target estimated on the server 200 side may be registered. FIG. 17 is a flowchart showing a process when the server 200 estimates the normal behavior of the detection target.

First, the reception unit 210*a* of the control unit 210 of the server 200 receives the image data transmitted from the mobile body 100, the imaging time, the positioning information of the mobile body 100, and the internal parameters of the camera 140 (step S40). Next, the detection target determination unit 210*c* of the control unit 210 determines whether the detection target exists in the image received from the mobile body 100 (step S42). When the detection target exists in the image, the normal behavior estimation unit 210*d* specifies the position of the detection target based on the position of the detection target in the image and the position of the mobile body 100 when the image was captured (step S44), and accumulates the combination of the position of the detection target and the imaging time of the image in the storage unit 230 (step S46). On the other hand, when the detection target does not exist in the image in step S42, the process returns to step S40 and the processes of step 40 and after are performed again.

After step S46, the normal behavior estimation unit 210*d* determines whether a predetermined number of combinations of the position of the detection target and the time has been accumulated (step S48), and when a predetermined number has been accumulated, estimates the normal behavior of the detection target based on the accumulated predetermined number of the positions of the detection target and the times (step S50). When a predetermined number has not been accumulated in step S48, the process returns to step S40 and the processes of step 40 and after are performed again.

Modification

When the user's schedule is registered in the storage unit 230 of the user terminal 300, the user terminal 300 may share the schedule information with the server 200. In this case, even when the abnormal behavior determination unit 210*e* determines that the detection target exhibits an abnormal behavior, the alert transmission unit 210*f* of the control unit 210 of the server 200 does not need to transmit an alarm when the abnormal behavior is based on a behavior registered in the schedule. This suppresses the transmission of alerts that are unnecessary for the user.

Further, when the detection target is a vehicle owned by the user, the position information of the user terminal 300 and the position information of the vehicle may be shared on the server 200 side, and an alert may be transmitted to the owner upon determining that the vehicle has been stolen when the user terminal 300 and the vehicle are not at the same position while the vehicle is moving.

Furthermore, when the vehicle that is the detection target is equipped with a driver monitoring camera, the driver may constantly be specified by the driver monitoring camera. When a person who is not registered in advance is driving the vehicle, the above information may be transmitted from the vehicle to the server 200, and an alert may be transmitted from the server 200 to the user terminal 300 of the user who owns the vehicle.

As described above, according to the present embodiment, the user can receive an alert when the detection target desired to be watched over exhibits an abnormal behavior different than usual, so that the user can detect the abnormal behavior at an early stage. Therefore, the user can take appropriate measures for the detection target that exhibits the abnormal behavior.

What is claimed is:

1. An abnormal behavior notification device comprising:

a registration unit that registers identification information for identifying a detection target in a storage unit;

a determination unit that determines whether the detection target is shown in an image captured on or around a road, based on the identification information;

an abnormal behavior determination unit that determines whether the detection target exhibits an abnormal behavior that is different from a normal behavior of the detection target, when the detection target is shown in the image; and a transmission unit that transmits an alert when the detection target exhibits the abnormal behavior, wherein the registration unit registers the identification information received from a user terminal and the registration unit registers the normal behavior received from the user terminal together with the identification information.

2. The abnormal behavior notification device according to claim 1, wherein the image is an image captured by a mobile body traveling on the road.

3. The abnormal behavior notification device according to claim 2, wherein:

the normal behavior is that the detection target moves in a predetermined movement route and a predetermined time zone; and the abnormal behavior determination unit determines that the detection target exhibits the abnormal behavior that is different from the normal behavior when a position of the detection target based on a position of the mobile body when the image showing the detection target is captured is not included in the predetermined movement route, or when a time at which the image is captured is not included in the predetermined time zone.

4. The abnormal behavior notification device according to claim 1, wherein the detection target is a vehicle, and the identification information is information of a license plate of the vehicle.

5. The abnormal behavior notification device according to claim 1, wherein the detection target is a specific person, and the identification information is a facial image of the specific person.

6. The abnormal behavior notification device according to claim 1, wherein the transmission unit transmits the alert to the user terminal.

7. The abnormal behavior notification device according to claim 3, further comprising an estimation unit that specifies, based on the identification information, from a plurality of images showing the detection target captured by the mobile body in the past, positions of the detection target when the images are captured, and estimates the predetermined movement route and the predetermined time zone based on the specified positions of the detection target and imaging times of the images.

8. The abnormal behavior notification device according to claim 1, wherein:

the detection target is a specific person, and the normal behavior is that the specific person is accompanied by an attendant; and when the specific person is shown in the image and the same other person is not shown in the image continuously for a predetermined time or more within a predetermined distance from the specific person, the abnormal behavior determination unit determines that the specific person exhibits the abnormal behavior that is different from the normal behavior.

9. The abnormal behavior notification device according to claim 8, wherein the identification information is a facial image of the specific person.

10. An abnormal behavior notification system including a user terminal owned by a user and an abnormal behavior notification device communicably connected to the user terminal, the abnormal behavior notification system comprising:

an acquisition unit that acquires identification information for identifying a detection target input to the user terminal;

a registration unit that registers the identification information in a storage unit;

a determination unit that determines whether the detection target is shown in an image captured on or around a road, based on the identification information;

an abnormal behavior determination unit that determines whether the detection target exhibits an abnormal behavior that is different from a normal behavior of the detection target, when the detection target is shown in the image; and a transmission unit that transmits an alert to the user terminal when the detection target exhibits the abnormal behavior wherein the registration unit registers the identification information received from a user terminal and the registration unit registers the normal behavior received from the user terminal together with the identification information.

11. An abnormal behavior notification method comprising:

a step of registering identification information for identifying a detection target in a storage unit;

a step of determining whether the detection target is shown in an image captured on or around a road, based on the identification information;

a step of determining whether the detection target exhibits an abnormal behavior that is different from a normal behavior of the detection target, when the detection target is shown in the image; and a step of transmitting an alert when the detection target exhibits the abnormal behavior, wherein the registered identification information is received from a user terminal and the normal behavior received from the user terminal is registered together with the identification information.

12. An abnormal behavior notification device comprising:

a registration unit that registers identification information for identifying a detection target in a storage unit;

a determination unit that determines whether the detection target is shown in an image captured by a mobile body traveling on a road, based on the identification information;

an abnormal behavior determination unit that determines whether the detection target exhibits an abnormal behavior that is different from a normal behavior of the detection target, when the detection target is shown in the image; and a transmission unit that transmits an alert when the detection target exhibits the abnormal behavior, wherein:

the normal behavior is that the detection target moves in a predetermined movement route and a predetermined time zone; and the abnormal behavior determination unit determines that the detection target exhibits the abnormal behavior that is different from the normal behavior when a position of the detection target based on a position of the mobile body when the image showing the detection target is captured is not included in the predetermined movement route, or when a time at which the image is captured is not included in the predetermined time zone.

13. The abnormal behavior notification device according to claim 12, wherein the detection target is a vehicle, and the identification information is information of a license plate of the vehicle.

14. The abnormal behavior notification device according to claim 12, wherein the detection target is a specific person, and the identification information is a facial image of the specific person.

15. The abnormal behavior notification device according to claim 12, wherein the transmission unit transmits the alert to the user terminal.

16. The abnormal behavior notification device according to claim 1, further comprising an estimation unit that specifies, based on the identification information, from a plurality of images showing the detection target captured by the mobile body in the past, positions of the detection target when the images are captured, and estimates the predetermined movement route and the predetermined time zone based on the specified positions of the detection target and imaging times of the images.

17. The abnormal behavior notification device according to claim 12, wherein:

the detection target is a specific person, and the normal behavior is that the specific person is accompanied by an attendant; and when the specific person is shown in the image and the same other person is not shown in the image continuously for a predetermined time or more within a predetermined distance from the specific person, the abnormal behavior determination unit determines that the specific person exhibits the abnormal behavior that is different from the normal behavior.

18. The abnormal behavior notification device according to claim 12, wherein the identification information is a facial image of the specific person.

* * * * *